US007063075B2

(12) United States Patent
Berger et al.

(10) Patent No.: US 7,063,075 B2
(45) Date of Patent: Jun. 20, 2006

(54) FIXING DEVICE

(75) Inventors: Werner Berger, Markgroeningen (DE); Martin Mueller, Moeglingen (DE); Andreas Glaser, Stuttgart (DE); Anh-Tuan Hoang, Tamm (DE); Martin Buehner, Backnang (DE); Cedric Olivier, Ludwigsburg (DE)

(73) Assignee: Robert Bosch GmbH, Stuttgart (DE)

( * ) Notice: Subject to any disclaimer, the term of this patent is extended or adjusted under 35 U.S.C. 154(b) by 162 days.

(21) Appl. No.: 10/451,874

(22) PCT Filed: Oct. 1, 2002

(86) PCT No.: PCT/DE02/03715

§ 371 (c)(1),
(2), (4) Date: Dec. 16, 2003

(87) PCT Pub. No.: WO03/038267

PCT Pub. Date: May 8, 2003

(65) Prior Publication Data

US 2005/0066941 A1 Mar. 31, 2005

(30) Foreign Application Priority Data

Oct. 24, 2001 (DE) ..... 101 52 421

(51) Int. Cl.
*F02M 37/04* (2006.01)

(52) U.S. Cl. ..... 123/470; 123/456

(58) Field of Classification Search ..... 123/470, 123/469, 468, 456, 472; 239/600
See application file for complete search history.

(56) References Cited

U.S. PATENT DOCUMENTS

| | | | | |
|---|---|---|---|---|
| 5,074,269 | A | 12/1991 | Herbon et al. | |
| 5,136,999 | A * | 8/1992 | Bassler et al. | 123/470 |
| 5,501,195 | A * | 3/1996 | Hall | 123/470 |
| 5,577,478 | A * | 11/1996 | Tuckey | 123/456 |
| 5,803,052 | A * | 9/1998 | Lorraine et al. | 123/470 |
| 5,901,688 | A * | 5/1999 | Balsdon et al. | 123/516 |
| 6,276,339 | B1 | 8/2001 | Shebert, Jr. et al. | |
| 6,431,151 | B1 * | 8/2002 | Gmelin | 123/470 |
| 6,481,420 | B1 * | 11/2002 | Panasuk et al. | 123/470 |

FOREIGN PATENT DOCUMENTS

| | | |
|---|---|---|
| DE | 29 26 490 | 2/1981 |
| DE | 195 36 441 | 4/1997 |
| DE | 197 35 665 | 8/2002 |

* cited by examiner

*Primary Examiner*—Carl S. Miller
(74) *Attorney, Agent, or Firm*—Kenyon & Kenyon

(57) ABSTRACT

A mounting device for attaching a fuel injector both to a cylinder head of an internal combustion engine and to a fuel distribution line, includes two spring tongues which are insertable into a holding groove of the fuel injector or the fuel distribution line. A distance between the tips of the spring tongues is smaller than the largest diameter of the opening surface enclosed by them, and the spring tongues are radially elastically displaced with respect to an axis of the fuel injector. At least two spring elements, elastically displaced in the axial direction with respect to the spring tongues by either tensile or compressive forces, are formed and are axially non-positively, detachably connectable to the opposite fuel injector or the fuel distribution line via a catch connection.

8 Claims, 2 Drawing Sheets

FIXING DEVICE

FIELD OF THE INVENTION

The present invention relates to a mounting device for attaching a fuel injector to a cylinder head of an internal combustion engine, as well as for connecting the fuel injector to a fuel distribution line.

BACKGROUND INFORMATION

German Published Patent Application No. 29 26 490 refers to a mounting device for mounting a fuel injector on an intake manifold, where a mounting element axially attaches the fuel injector to the fuel distribution line or to a plug nipple. The mounting element is designed as a U-shaped securing clamp having two legs which are elastic in the radial direction. In the assembled state, the securing clamp engages corresponding recesses of the plug nipple and is snappable in a recess in a connection fitting of the fuel injector, the recess being designed as a ring groove. The axial clearance between the recesses and the securing clamp, as well as between the ring groove and the securing clamp, should be kept small in order to achieve accurate attachment of the fuel injector without stresses on the gasket.

A disadvantage of the mounting device referred to in German Published Patent Application No. 29 26 490 C2 is the fact that hold-down forces may only be transferred to a limited extent. In particular, it is not possible to produce a relatively uniform hold-down force along a certain axial length in order to compensate positional tolerances. German Published Patent Application No. 29 26 490 C2 only relates to an intake manifold injection system, thus offering no solution on how positional tolerances in high pressure fuel distribution lines may be compensated.

SUMMARY OF THE INVENTION

The mounting device for a fuel injector according to the present invention provides for positional tolerances, in particular axial positional tolerances, between the fuel injector and the fuel distribution line which may be compensated by further stressing the spring elements. Using the spring elements, the fuel injector is held down in the cylinder head by a hold-down force when the fuel distribution line is mounted on the cylinder head and is pushed toward the cylinder head. From a rest position, the spring elements are stressed by axial pressure which provides a hold-down force on the fuel injector.

Furthermore, by using the mounting device, the fuel injector may be connected to the fuel distribution line as early as at the time of the assembly and may be removed complete in one unit composed of the mounting device, the fuel injector, and the fuel distribution line at the time of each disassembly. The spring elements are under tensile stress and the mounting device is able to pull the fuel injector out of the cylinder head since the catch connections, as well as the spring tongues in the holding groove, transfer tensile and compressive forces.

Screws or securing clamping claws for mounting on the front face of the cylinder head are avoided by using the mounting device according to the present invention.

The catch connections may be formed by recesses in a section of the spring elements into which the catches of the fuel injector or the fuel distribution line are insertable. Due to the radial elastic force of the spring elements, this embodiment may snap in, requiring no additional components.

In another embodiment, the spring elements may have a fold facing radially outward. The bent section of the spring elements allows influencing either the tensile or compressive spring constants.

The mounting device may be made of injection-molded plastic.

Alternatively, the mounting device may be made of spring sheet metal and manufactured as a punched piece being subsequently bent to shape. On the side facing the holding groove, the spring tongues, at least in a partial section, may be axially bent so that the tongues may be fastened in an axially elastic manner without play during insertion into the holding groove.

The two alternatives allow for cost-effective manufacturing methods.

The holding groove may be formed on the fuel injector. The catching connection may be formed on the fuel distribution line. The mounting device in the holding groove requires the smaller overall height and may therefore be mounted on the fuel injector.

BRIEF DESCRIPTION OF THE DRAWINGS

Exemplary embodiments of the present invention are illustrated in the drawing in a simplified form and are explained in greater detail in the following description.

DETAILED DESCRIPTION

Figure 1:
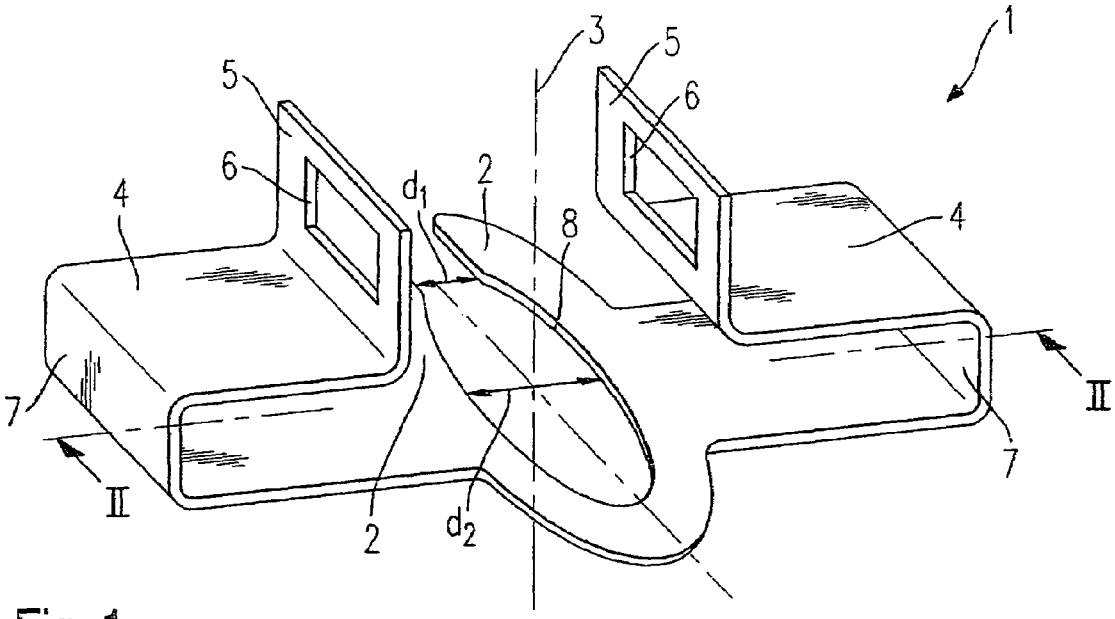
FIG. 1 is a perspective view of a first exemplary embodiment of a mounting device according to the present invention.

FIG. 1 is a perspective view of a first exemplary embodiment of a mounting device 1 according to the present invention for a fuel injector to be mounted on a fuel distribution line. Two spring tongues 2 are formed on mounting device 1, the spring tongues having an opening surface of a maximum diameter d2 between them. This opening surface is positioned perpendicularly to an imaginary axis 3 which is identical to an axis of symmetry of the fuel injector.

Spring tongues 2 have a distance d1 between tips which is smaller than distance D2. Mounting device 1 may be mounted on the fuel injector using spring tongues 2 which are insertable into a holding groove. This allows lateral slip on mounting device 1. This-causes a friction-type locking in the longitudinal direction of axis 3. In the present exemplary embodiment, spring tongues 2 are joined by two spring elements 4 which may be elastically displaced in the direction of axis 3, either by tensile or compressive forces.

The mounting device in its relieved state, i.e., no force acts on spring elements 4, is illustrated in FIG. 1. Recesses 6 are situated in contact sections 5 of spring elements 4. The fuel distribution line may have corresponding catches which may lock into the recesses. This allows a friction-type locking with the fuel distribution line in the longitudinal direction of axis 3. Radially with respect to axis 3, spring elements 4 have fold area 7 whose folds, in the present example, have a sharp-edged design. In an edge area 8, spring tongues 2 are slightly bent.

With respect to the longitudinal direction of axis 3, spring elements 4 have one spring constant for a force which is trying to increase the distance of recesses 6 vis-a-vis spring tongues 2, as well as a second spring constant for a force which is trying to reduce this distance. Thus, in a certain elasticity range, forces may be transferred between recesses 6 and spring tongues 2 by both pulling and compression in the direction of axis 3 with an intermediate neutral area.

Figure 2:
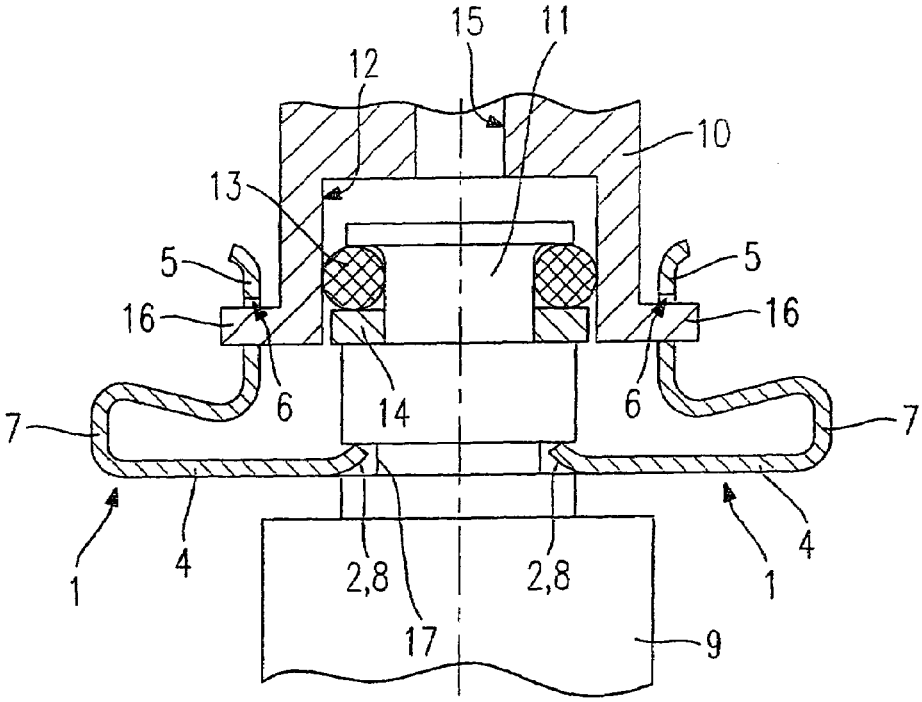
FIG. 2 is a schematic sectional view of the exemplary embodiment of FIG. 1 in a mounted position on a fuel injector and a fuel distribution line.

FIG. 2 is a schematic sectional view of the exemplary embodiment of FIG. 1 in the mounted position for a fuel injector 9 mounted on a fuel distribution line 10. With an end section 11, fuel injector 9 is inserted in a location hole 12 of fuel distribution line 10. An O ring 13, which is supported by a support ring 14, seals end section 11 against location hole 12. The fuel flows toward location hole 12 via a bore 15. With its recesses 6, mounting device 1 is locked in catches 16 on fuel distribution line 10. The mounting device is depicted sectionally in the plane of section defined in FIG. 1 by line 2 and axis 3. Spring tongues 2 including edge area 8, which is slightly bent, are inserted into holding groove 17 which is formed on fuel injector 9. The respective folding areas 7 of both spring elements 4 are positioned radially outwards. The parts of spring elements 7 upstream and downstream of folding area 7 are no longer positioned parallel since fuel distribution line 10 exerts a pressure force on fuel injector 9 in the direction of the flow direction of the fuel, the pressure force being transferred from catches 16 to holding groove 17 by mounting device 1. This holding force is the required hold-down force for securely holding the fuel injector on a cylinder head against the pressure of a combustion chamber. Bent edge area 8 prevents spring tongues 2 from having any play in holding groove 17, because jamming occurs.

In the case of disassembly, fuel injector 9 and fuel distribution line 10 may be removed together. If fuel distribution line 10 is pulled in the direction opposite to the flow direction of the fuel in inflow bore 15, each spring element 4 is pulled beyond its fulcrum and no longer exerts any pressure force on fuel injector 9. A pulling force is transferred to fuel injector 9 via holding groove 17 and fuel injector 9 is pulled away from a cylinder head. It may thus be removed together with fuel distribution line 10.

However, fuel distribution line 10 may be removed alone by removing mounting device 1 beforehand. This may take place by stressing contact areas 5 of spring elements 4 radially outwards to the extent that they may be removed from catches 16. At the same time, the mounting device all together may be pulled out of holding groove 17, in the illustration forward towards the viewer, by spring tongues 2 spreading wide enough so that distance d1 in FIG. 1 becomes large enough to be pulled over the diameter of holding groove 17 into its base.

This mounting device 1 may be easily manufactured by stamping the device 1 out of spring sheet metal and subsequent bending to shape. Large hold-down forces may be transferred by selecting suitable materials. The use of otherwise required components such as a mounting securing clamp and screwing arrangements is thereby avoided.

Figure 3A:
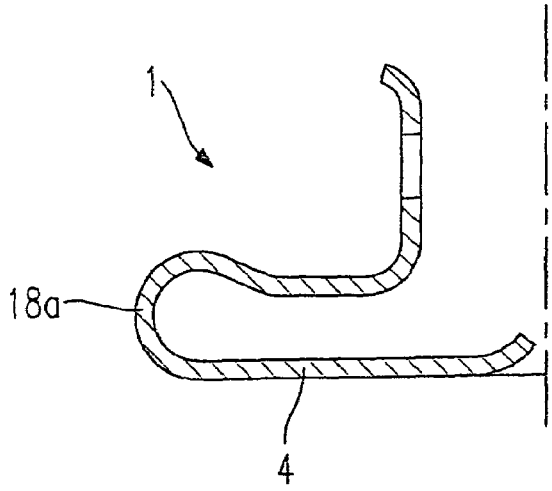
FIG. 3*a* is a second exemplary embodiment of a mounting device in a schematic detail section.
Figure 3B:
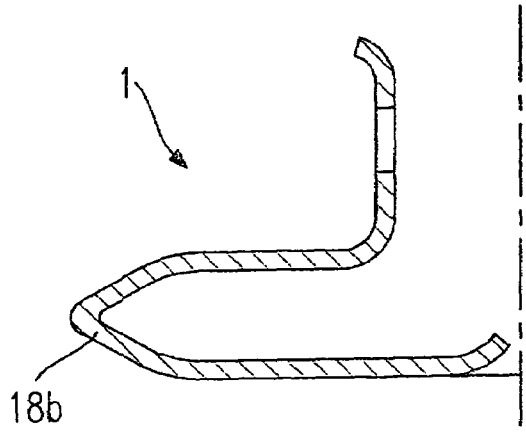
FIG. 3*b* is a third embodiment of a mounting device in a schematic detail section.
Figure 3C:
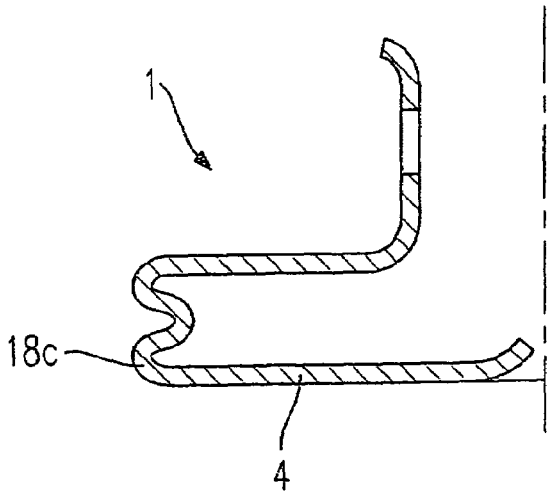
FIG. 3*c* is a fourth exemplary embodiment of a mounting device in a schematic detail section.

FIGS. 3*a*, 3*b*, and 3*c* show in schematic sections further exemplary embodiments of mounting device 1 according to the present invention of FIG. 1 and FIG. 2, having differing folding areas compared to folding area 7 of FIGS. 1 and 2. Due to the symmetry, only one side of mounting device 1 is illustrated. Folding area 18*a* in FIG. 3*a* is configured as a semicircular arch. This prevents a notch effect in the area of spring element 4. The bending moment over semicircular arch 18*a* is relatively uniform. As an example, FIG. 3*b* illustrates an acute-angled folding area 18*b*. Finally, FIG. 3*c* illustrates a multiple fold 18*c* in the area of spring elements 4.

Both last-mentioned exemplary embodiments allow for a relatively low spring constant possible.

What is claimed is:

1. A mounting device for attaching a fuel injector both to a cylinder head of an internal combustion engine and to a fuel distribution line, the mounting device comprising:

two spring tongues which are insertable into a holding groove in one of the fuel injector and the fuel distribution line, a distance between tips of the spring tongues being smaller than a largest diameter of an opening surface enclosed by the tips, wherein the spring tongues are radially elastic with respect to an axis of the fuel injector; and at least two spring elements, elastically displaced in a direction of the axis with respect to the spring tongues by one of tensile and compressive forces, the elements formed and configured to be axially non-positively, detachably connectable to one of the fuel injector and the fuel distribution line via a catch connection, wherein on a side facing the holding groove, the spring tongues, at least in a partial section, are axially bent so that clearance-free, axially elastic jamming occurs when the spring tongues are inserted into the holding groove.

2. The mounting device according to claim 1, wherein the catch connection is formed by recesses in a section of the spring elements, wherein catches of one of the fuel injector and the fuel distribution line are inserted into the recesses.

3. The mounting device according to claim 1, wherein the spring elements have a fold radially outward.

4. The mounting device according to claim 3, wherein the fold is a multiple fold.

5. The mounting device according to claim 1, wherein the mounting device is made of injection-molded plastic.

6. The mounting device according to claim 1, wherein the mounting device is made of spring sheet metal and is manufactured as a punched piece that is subsequently bent to shape.

7. The mounting device according to claim 1, wherein at least three spring elements are radially and uniformly arranged.

8. The mounting device according to claim 1, wherein the holding groove is formed on the fuel injector, and the catch connection is formed on the fuel distribution line.

* * * * *